US005676081A

United States Patent [19]

Kobelt

[11] Patent Number: 5,676,081

[45] Date of Patent: Oct. 14, 1997

[54] TILTING HELM FOR MARINE VESSEL

[76] Inventor: Jacob Kobelt, 1685 Ocean Park Road, Surrey, British Columbia, Canada, V4A 4V5

[21] Appl. No.: 558,284

[22] Filed: Nov. 13, 1995

[51] Int. Cl.[6] ..... B63H 25/00

[52] U.S. Cl. ..... 114/144 R; 114/150; 74/493

[58] Field of Search ..... 114/144 R, 150; 74/443, 493, 494, 498, 540

[56] References Cited

U.S. PATENT DOCUMENTS

| | | | |
|---|---|---|---|
| 3,205,968 | 9/1965 | Rose | 74/493 |
| 4,449,420 | 5/1984 | Baba | 114/144 R |
| 4,537,089 | 8/1985 | Moneta | 74/493 |
| 5,136,894 | 8/1992 | Carter et al. | 114/144 R |

*Primary Examiner*—Jesus D. Sotelo
*Attorney, Agent, or Firm*—Bull, Housser & Tupper

[57] ABSTRACT

A marine helm pump assembly comprises a helm pump unit and a helm pump mounting cooperating with the helm pump unit. The helm pump unit is connectable with hydraulic conduits to a steering assembly and cooperates with a rotatable helm to be gripped by an operator. The helm pump mounting is securable to a portion of the marine vessel, which can sometimes be restricted to access by an operator. The helm pump unit is mounted for limited rotation with respect to the helm pump mounting about a tilt axis passing transversely through the unit and the mounting to permit the rotatable helm to be tilted or swivelled about the tilt axis through an arc centred on the tilt axis to change orientation of the helm. This tilting can accommodate orientation preferences of the operator, as well as facilitating access to, or exit from, a restricted area adjacent to the helm. Because the helm pump can rotate with respect to the helm pump mounting, problems associated with prior art articulated steering columns are eliminated.

17 Claims, 4 Drawing Sheets

TILTING HELM FOR MARINE VESSEL

BACKGROUND OF THE INVENTION

The invention relates to a manually rotatable steering helm of a marine vessel, which is also tiltable to accommodate operator's preferences with respect to orientation of the helm.

It is known to provide a tiltable helm for a marine vessel to facilitate access to, and exit from, a restricted sized helm station on a marine vessel as well as to accommodate the operator's personal preferences relating to orientation of the helm. In some marine vessels, there is often a restricted passageway or space for an operator to access the steering helm, and it is known to provide a helm which can be tilted or swung between a non-operative position which is generally clear of the passageway and an operative position which tends to obstruct the passageway.

One type of tilting helm resembles that of a tilting steering wheel of an automobile which comprises an articulated steering column having an outer column portion carrying the steering wheel (or helm), and an inner column portion serving as an input shaft projecting from the steering unit (or helm pump unit). The steering unit (or helm pump unit) is secured to the remainder of the automobile (or vessel), and a simple universal joint or Hooke's joint connects adjacent ends of the column portions together. The outer column portion is supported in bearings which concurrently provide rotational support for the outer column, and also accommodate limited rotation or swinging of the outer column portion with respect to the inner column portion as the operator tilts the steering wheel (or helm). Usually, the bearing for the outer column portion is supported by a sliding, partially cylindrical shell which can slide over a complementary mounting secured relative to the automobile (or vessel).

Such an arrangement is acceptable for automobile use where steering forces can be relatively low and predictable, but difficulties can arise if this type of mounting is used in a marine steering application where forces can be unpredictable and much higher. There can be difficulty in providing a sufficiently strong structure to resist forces imposed on the outer portion of the articulated steering column which can occur in heavy seas. In addition, in such units, it is known that a uniform input rotation of the rotatable helm by the operator does not result in a uniform output flow from the helm pump because the shafts are not aligned in most applications, and thus such an arrangement can generate irregular steering signals.

SUMMARY OF THE INVENTION

The invention reduces the difficulties and disadvantages of the prior art by providing a helm pump assembly in which the helm pump unit itself is tiltable about a tilt axis with respect to the marine vessel, and has a helm mounted on a non-articulated or rigid pump shaft of the helm pump unit. Thus the input shaft can be in one piece to eliminate the universal or Hooke's coupling commonly associated with the prior art articulated shaft. The non-articulated shaft of the invention eliminates non-uniformity between the helm input rotation and the helm output flow as previously described which can occur with non-aligned steering columns of the prior art tilting helm. Thus, the invention provides a more simple connection which can be made stronger to resist forces imposed thereon during heavy duty use, for less cost than the prior art structure known to the inventor.

A helm pump assembly according to the invention comprises a helm pump unit and a helm pump mounting. The helm pump unit is connectable with hydraulic conduits to a steering assembly to generate steering signals for the steering assembly. The helm pump unit cooperates with the rotatable helm to be actuated by an operator, and the helm pump mounting cooperates with the helm pump unit and is securable to a portion of a marine vessel. The helm pump unit cooperates with the helm pump mounting for limited rotation about a tilt axis disposed transversely of the pump unit and the pump mounting. This permits the rotatable helm to be tilted or swivelled about the tilt axis through an arc centred on the tilt axis to accommodate preferences of the operator.

Preferably, a latching structure cooperates with the helm pump unit and the helm pump mounting to releasably lock the helm pump unit in a desired orientation relative to the helm pump mounting. The latching structure comprises a first latching member having a plurality of spaced apart latching stations extending therealong, and a second latching member complementary to the first latching member and adapted to cooperate with the latching stations. In an engaged position thereof, the second latching member engages one of the latching stations and thus holds the helm pump unit in a fixed orientation relative to the helm pump mounting. The second latching member is moveable to a disengaged position thereof in which the latching members are disengaged, thus permitting free rotation of the helm pump unit about the tilt axis between extreme first and second position thereof.

A detailed disclosure following, related to drawings, describes a preferred embodiment of the invention which is capable of expression in structure other than particularly described and illustrated.

DETAILED DESCRIPTION

Figure 1:
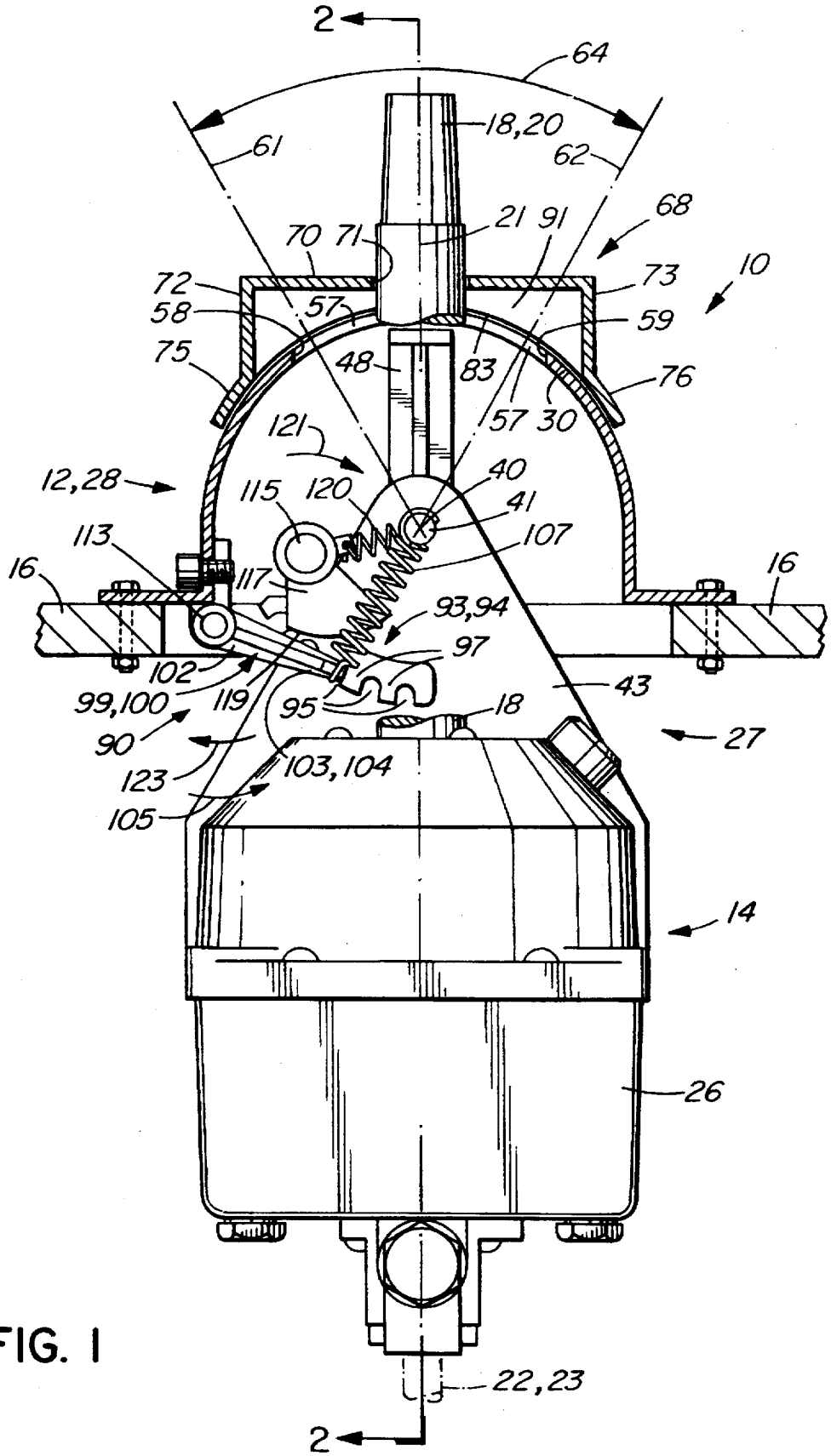
FIG. 1 is a simplified, fragmented side elevation of a helm pump assembly according to the invention mounted on structure of a marine vessel, some portions being shown in section as would be seen generally from Line 1—1 of FIG. 2, and some portions being broken away to show internal structure.
Figure 2:
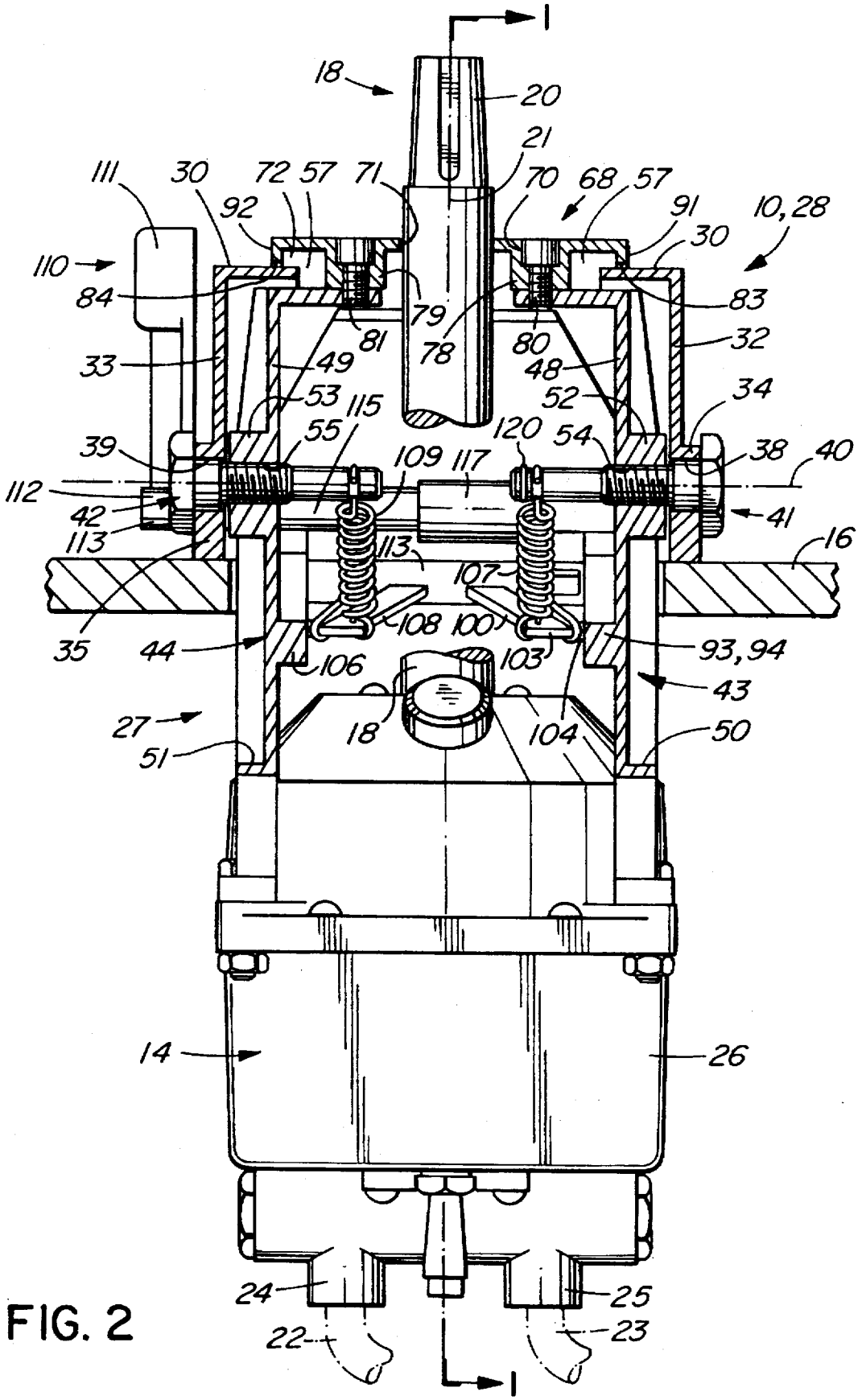
FIG. 2 is a simplified, fragmented front elevation of the assembly of FIG. 1, with some portions shown in section as would be seen generally on Line 2—2 of FIG. 1.

As best seen in FIGS. 1 and 2, a helm pump assembly 10 according to the invention comprises a helm pump mounting cooperating with a helm pump unit 14. The helm pump mounting is secured to a generally horizontal platform 16 which is fixed to a portion of a marine vessel, not shown. The platform 16 is commonly a generally horizontal shelf mounted in the "bridge" or other helm station of the vessel, the shelf having an opening to receive the assembly which is secured to the shelf and would normally result in a vertical axis of rotation for a fixed shaft helm. Some operators prefer a sloping or inclined helm for comfort, and this would not be possible if the helm pump is mounted horizontally and has a fixed vertical input shaft. In other installations, the helm pump can be mounted with the input shaft extending horizontally or obliquely therefrom, but in such positions it can obstruct access to the helm pump station if the vessel is relatively small and the bridge has restricted access. In such installations, the tilting helm of the invention is helpful to facilitate access to, and exit from, the helm station.

The helm pump unit 14 has an input shaft 18 extending outwardly from the helm pump unit to an outer end 20 which carries a wheel or other suitably shaped steerable or rotatable helm for gripping and actuation by an operator, not shown. Thus the rotatable helm is mounted on a steering column which also serves as the pump input shaft, and has an input shaft axis 21 disposed generally symmetrically of the assembly 10. The helm pump unit 14 is a conventional helm pump comprising a swash-plate type of hydraulic pump which has a housing 26 with fluid ports 24 and 25 connected to flexible conduits 22 and 23, shown in broken outline. The pump displaces fluid through the conduits which extend to a steering assembly to rotate the steering assembly in response to steering signals generated by the helm pump. Most aspects of the helm pump are conventional, and further description is unnecessary.

The assembly 10 further includes a tilting frame 27 which is rigidly connected to the pump housing 26 and hingedly mounted on the pump mounting 12 as will be described. Thus, the tilting frame 27 serves as a means of swivellably mounting the helm pump unit 14 to the helm pump mounting 12 and the tilting frame 27 and the resulting combination are of importance in the present invention.

The helm pump mounting 12 has a hollow housing 28 having a generally semi-cylindrical outer or upper housing wall 30 and a pair of generally parallel, flat housing sidewalls 32 and 33 which are disposed in generally parallel vertical planes and extend between opposite edges of the outer housing wall. The sidewalls 32 and 33 have lower portions provided with bosses 34 and 35 respectively to increase strength of lower portions of the sidewalls. The bosses 34 and 35 have openings 38 and 39 therein, the openings being aligned with each other about a tilt axis 40 which is intersected by the axis 21. The openings 38 and 39 serve as journals for mounting portions of respective bolts 41 and 42 which cooperate with the tilting frame 27 and thus the pump unit 14 as will be described.

Figure 3:
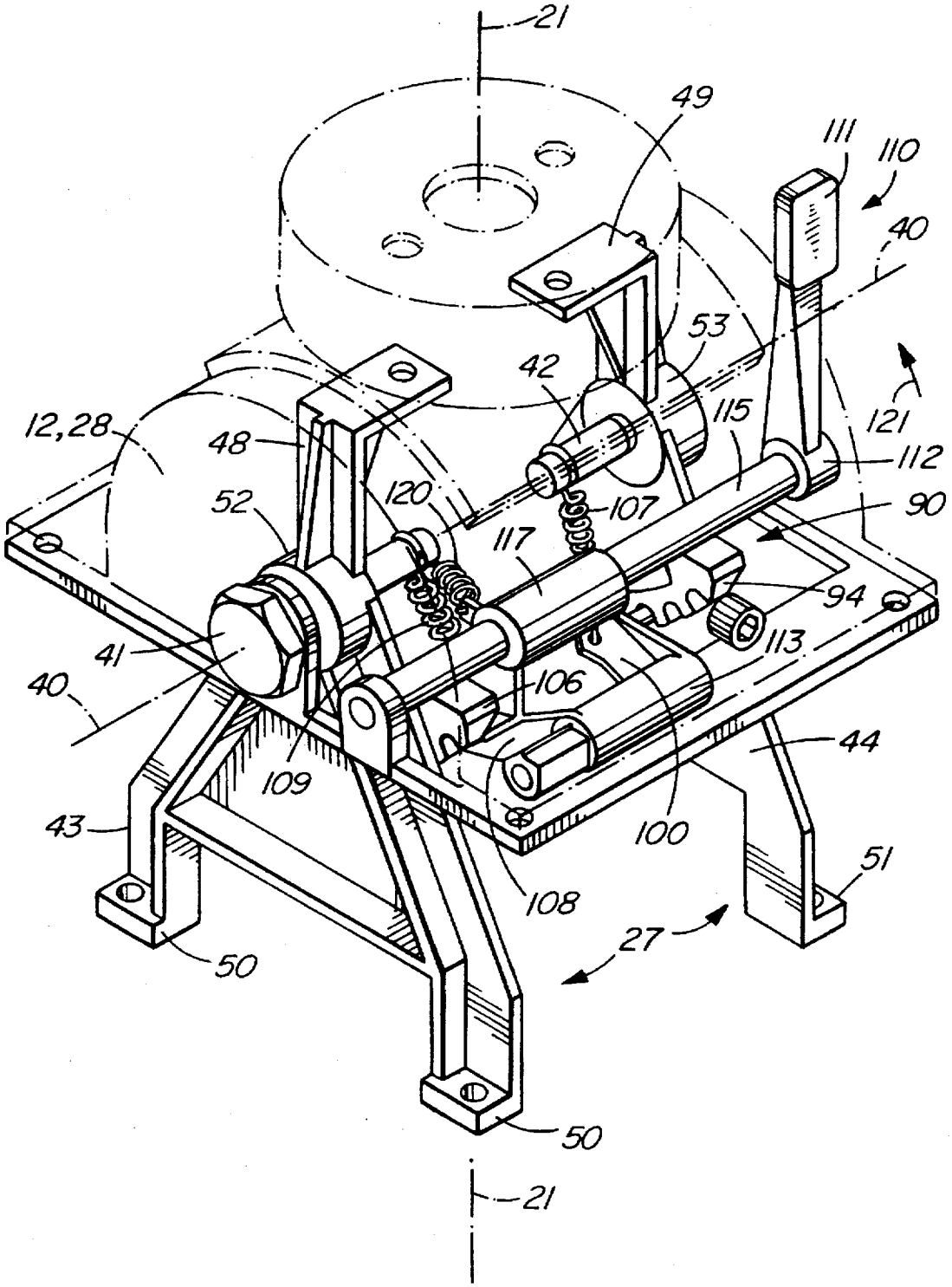
FIG. 3 is a partially fragmented perspective of main structural portions of the invention, some prior art structure being omitted for clarity, and some portions of the invention being shown in phantom.

Referring also to FIG. 3, the tilting frame 27 has a pair of generally vertically disposed, parallel, triangular-shaped side frames 43 and 44 having respective frame bosses 52 and 53 with respective threaded openings 54 and 55. The openings 54 and 55 are aligned about the tilt axis 40 and receive complementary threaded portions of the bolts 41 and 42 therein, so as to hinge the tilting frame 27 to the housing. Lower ends 50 and 51 of the side frames 43 and 44 are secured to undesignated bosses on the pump housing 26 to provide a rigid connection therewith. The frame 27 further includes a pair of parallel L-shaped struts 48 and 49 which are integral with the frames 43 and 44 respectively and extend upwardly from the bosses 52 and 53 and are inclined inwardly at upper ends towards the shaft 18 but are spaced therefrom to provide clearance. The tilting frame 27 and the helm pump mounting are provided with suitable undesignated stiffening webs and gussets to ensure a rigid connection between the frame and pump housing. The housing 28 and the tilting frame 27 are preferably die cast in a corrosion-resistant metal such as phosphor brass or bronze, and can be made essentially rigid so as to withstand steering and twisting forces imposed thereon with negligible distortion. Thus, it can be seen that the helm pump unit 14 is mounted for limited rotation with respect to the helm pump mounting 12 about the tilt axis 40 which is disposed transversely of the unit and the mounting to permit the helm to be tilted or swivelled about the tilt axis, and yet is sufficiently rigidly supported to resist forces imposed thereon.

In addition, the tilt axis 40 is located between the helm pump unit 14 and the helm so that the helm mounting 12 resembles a teeter-totter which can be arranged to provide approximate weight balancing about the axis to relieve operation effort needed to change tilt.

As seen in FIG. 1, the outer housing wall 30 is generally concentric with the tilt axis and has an elongated slot 57 therein, the slot being within a plane normal to the axis 40, that is within an arc centred on the tilt axis, and thus extends generally perpendicularly to the cylindrical surface. The shaft 18 of the helm pump and axis 21 pass through the slot 57 of the housing which provides clearance for rotating or tilting the shaft about the axis 40. The elongated slot 57 in the outer housing wall 30 has slot end walls 58 and 59 which limit rotation or tilting of the helm pump about the helm pump axis between extreme positions of the input shaft, the axis of the shaft being shown in first and second extreme positions 61 and 62 defining an arc 64. Clearly, interference between the shaft 18 and the slot end walls 58 and 59 determines the extreme positions of the arc 64 through which the helm pump can be tilted with respect to the helm pump mounting.

The assembly 10 further includes a shield member 68 which has a generally flat circular base portion 70 having an opening 71 to receive the input shaft 18 of the helm pump extending therethrough. The shield member further includes first and second end portions 72 and 73 which extend downwardly from the base portion to outwardly extending elongated edge portions 75 and 76 which conform closely to the curvature of the outer housing portion 30. Generally similar shield bosses 78 and 79 extend inwardly from the base portion 70 and have counterbored openings to receive screws 80 and 81 respectively which engage complementary openings in the struts 48 and 49 of the frame 27 so as to secure the shield member indirectly to the helm pump unit. The two elongated edge portions 75 and 76 are disposed concentrically to the cylindrical sidewall 30 and are adapted to sweep the cylindrical wall as the helm rotates between extreme positions of the arc to partially seal small gaps between end portions and the sidewall 30. The shield member also has two generally flat and vertically disposed side portions 91 and 92 having arcuate edge portions 83 and 84 respectively which are also concentric with and adapted to pass closely adjacent the housing outer wall 30 so as to partially seal small gaps between the portions 91 and 92 and the sidewall 30. Thus peripherally extending gaps between the shield member and the housing unit are partially sealed as the helm rotates between extreme positions of the arc 64 to reduce ingress of foreign matter into the assembly 10.

Figure 4:
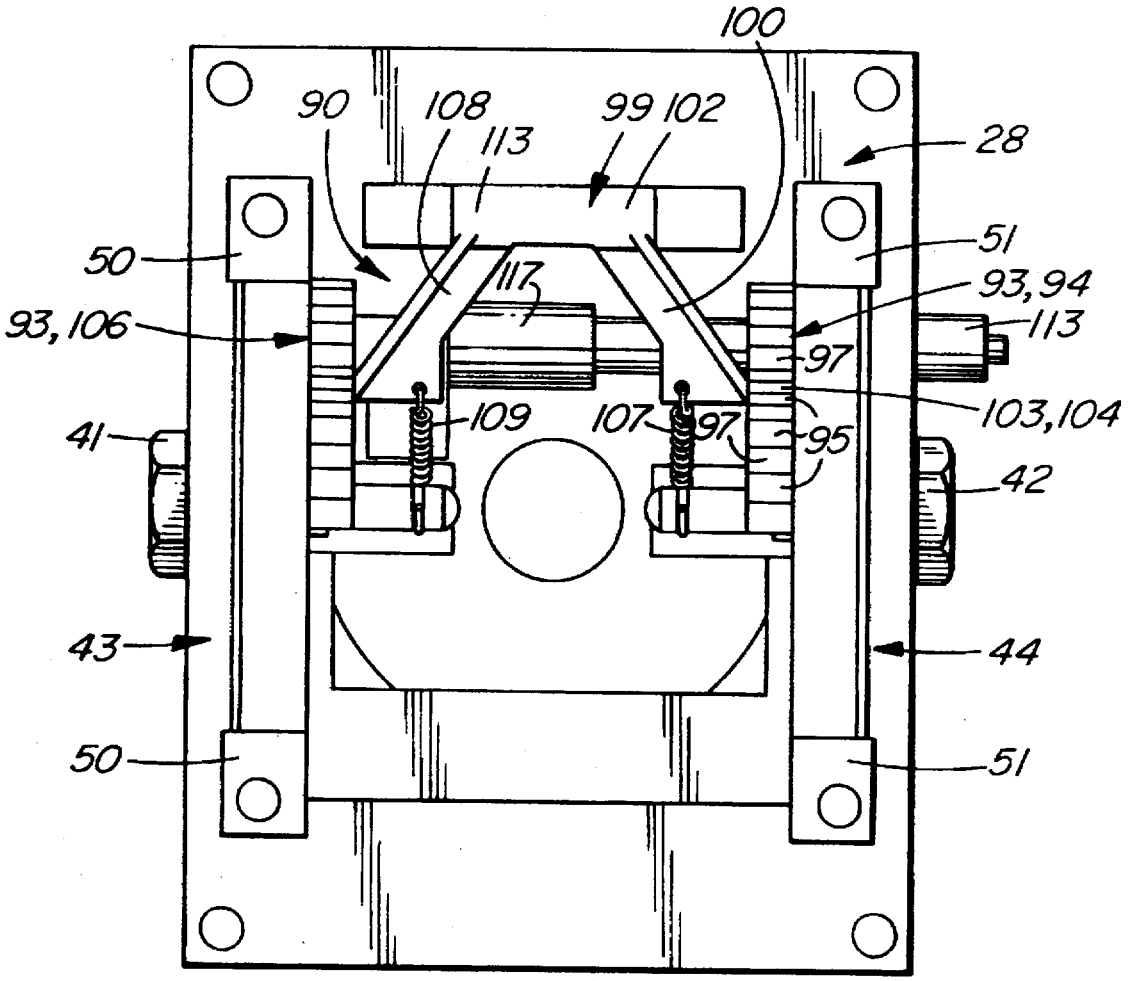
FIG. 4 is a simplified bottom plan view of portions of the invention, some prior art structure and portions of the invention being omitted for clarity.

As also shown in FIGS. 3 and 4, the pump assembly further includes a latching structure 90 which cooperates with the helm pump unit and helm pump mounting to releasably lock the helm pump unit in a desired orientation relative to the helm pump mounting. Thus the helm can be latched so as to be oriented in a suitable position to accommodate preferences of the operator, either for continuous use, or temporarily for facilitating access to or exit from the helm station. The latching structure comprises two pairs of first and second latching members, each pair being provided a respective side of the tilting frame 27. The first and second latching members are complementary to each other and permit the helm pump to be located in one of several selected positions between the two extreme positions. As each pair of first and second latching members are essentially identical, one pair only will be described in detail.

A first latching member 93 comprises an arcuate member 94 integral with and extending inwardly from the side frame 43 of the tilting frame so as to be fixed relative to the pump housing 26, and disposed so that an arc of the arcuate member is centered on the tilt axis 40. The arcuate member has a plurality of peripherally spaced apart recesses 95 extending therealong, the recesses being preferably equally spaced apart and separated by projections 97 as best seen in FIG. 1.

A second latching member 99 has a latching arm 100 having an inner portion 102 journalled for rotation with respect to the housing 28, i.e. hinged relative to the helm pump mounting. The arm has an outer portion 103 having a transversely extending detent 104 complementary to and adapted to engage one of the recesses 95 as required. A tension coil spring 107 extends between the arm 100 and an inner end of the bolt 41 to spring bias the arm upwardly per arrow 105 to engage the latching member. It can be seen that the first latching member has a plurality of spaced apart latching stations, namely the recesses 95, extending therealong, and the second latching member is complementary to the first latching member and adapted to cooperate with the latching stations to engage a specific recess so as to retain the helm pump unit and the helm pump mounting in a desired relative position.

The arcuate member 94 and the latching arm 100 are provided on one side of the helm pump unit and helm pump mounting to provide a portion of the latching structure 90. A similar arcuate member 106 and complementary latching arm 108 are provided on an opposite side of the tilting frame to provide similar first and second latching members respectively which function identically to the arcuate member 94 and the arm 100. A tension coil spring 109 extends between the bolt 42 and the latching arm 108 to function similarly to the spring 107. A sleeve 113 interconnects inner portions of the arms 100 and 108 to ensure simultaneous movement of the arms to lock both sides of the pump unit.

As best seen in FIGS. 1 and 3, the latching structure 90 further includes a manually actuated latching lever 110 which has an outer end 111 for gripping by an operator, and an inner end 112 mounted rigidly on a latching hinge pin 115 extending transversely across the housing and journalled for rotation in the sidewalls 32 and 33 of the housing. The pin 115 carries a latching cam 117 which has a curved cam face 119 which cooperates with the latching arm 100. The face 119 is shaped so that when the latching lever 110 is disposed vertically as shown in FIG. 3, the cam face is in a retracted position clear of the arm 100 as best seen in FIG. 1. In this position, the latching arms 100 and 108 engage the arcuate members 94 and 106 under influence of the springs 107 and 109. When the hinge pin 115 is fully rotated through approximately 90 degrees in direction of an arrow 121, the cam 117 similarly rotates so the cam face 119 contacts the latching arm, which contact is not shown, and rotates the arm outwardly in direction of an arrow 123 so as to disengage the latching arm from the first latching member. A tension coil return spring 120 extends between the latching cam 117 and the inner end of the bolt 41 to apply torque to the pin 115 to bias the cam to a retracted position as shown, thus maintaining the latching structure 90 engaged when the lever extends vertically as shown in FIG. 3, which represents normal operation. Clearly, because the latching arms 100 and 108 are connected together by the sleeve 113, there is no need for a second latching cam similar to the cam 117, although an additional cam to cooperate with the arm 108 could be included if considered necessary.

Thus, it can be seen that the first latching members, i.e. the arcuate members, cooperate with the second latching members, namely the latching arms, to cause each second latching member to move between the engaged and disengaged positions of the latching structure. Clearly, each cam surface contacts the respective second latching member to cause each second latching member to move between the engaged and disengaged positions thereof in response to rotation of the latching lever. Also it can be seen that the second latching member is moveable from an engaged position engaging one of the latching stations and thus holding the helm pump in a fixed orientation relative to the helm pump mounting, against spring bias to a disengaged position in which the latching members are disengaged. Clearly, when disengaged, the latching members permit free rotation of the helm pump unit about the tilt axis between the extreme positions thereof.

Operation

In operation, the helm pump assembly functions generally similarly to a conventional helm pump assembly with a tilting helm, but is considered to be much more rugged and thus more able to withstand unanticipated forces that can arise in extreme marine applications. Because the helm pump input shaft is non-articulated and serves as a steering column for the helm, or alternatively, an extension can be provided if necessary to be aligned with the helm input shaft, problems associated with an articulated steering column are eliminated.

The arc 64 determines maximum arc through which the shaft 18 can be tilted, and is typically about 45 degrees. This is usually sufficient to accommodate most situations and to permit an operator to adjust orientation of the helm to suit personal preferences, as well as facilitating access to and from a restricted helm station. The latching lever is normally held in the upright position as shown in FIG. 2 by the return spring 120, in which case the latching structure 90 is engaged. To swivel the shaft, the lever 110 is swung through approximately 90 degrees, causing the latching cam to rotate the latching arm 100 outwardly per the arrow 123, so as to disengage the detents from the respective recesses of the arcuate members so as to permit the tilting frame 27 and associated helm pump unit to rotate about the tilt axis 40.

What is claimed is:

1. A helm pump assembly comprising:

(a) a helm pump unit connectable with hydraulic conduits to a steering assembly to generate steering signals for the steering assembly, the helm pump unit having a rotatable helm pump input shaft which is rotatable by a helm actuated by an operator, and (b) a helm pump mounting cooperating with the helm pump unit, the helm pump mounting being securable to a portion of a marine vessel, the helm pump unit cooperating with the helm pump mounting to permit limited rotation of the helm pump unit about a tilt axis disposed transversely of the pump unit and the pump mounting and located between the helm pump unit and the helm, so as to permit the rotatable helm to be tilted or swivelled about the tilt axis through an arc centred on the tilt axis to accommodate preferences of the operator.

2. A helm pump assembly as claimed in claim 1, in which:

(a) the helm pump unit can be tilted with respect to the helm pump mounting between first and second extreme positions of the arc, and (b) a latching structure cooperates with the helm pump unit and the helm pump mounting to releasably lock the helm pump unit in a desired orientation relative to the helm pump mounting.

3. A helm pump assembly as claimed in claim 2, in which the latching structure comprises:

(a) a first latching member having a plurality of spaced apart latching stations extending therealong, and (b) a second latching member complementary to the first latching member and adapted to cooperate with the latching stations, the second latching member being movable from an engaged position engaging one of the latching stations and thus holding the helm pump unit in a fixed orientation relative to the helm pump mounting, to a disengaged position in which the latching members are disengaged, thus permitting free rotation of the helm pump unit about the tilt axis between the extreme positions thereof.

4. An assembly as claimed in claim 3, in which:

(a) the first latching member comprises an arcuate member fixed to one portion of the assembly so as to be centred on the tilting axis and having a plurality of peripherally spaced apart recesses therein extending along the first latching member, and (b) the second latching member is mounted for movement with respect to the remaining portion of the assembly so as to engage a recess of the first latching member to retain the helm pump unit and the helm pump mounting in a desired relative position.

5. An assembly as claimed in claim 4, in which:

(a) the first latching member is secured to the helm pump unit so as to be rotatable therewith, and (b) the second latching member is hinged relative to the helm pump mounting so as to be rotatable relative thereto between the engaged and disengaged positions of the latching structure.

6. An assembly as claimed in claim 5, in which:

(a) the second latching member is spring biased towards the engaged position of the latching structure.

7. An assembly as claimed in claim 5, further comprising:

(a) a manually actuated latching lever which cooperates with the second latching member to cause the second latching member to move between the engaged and disengaged positions of the latching structure.

8. An assembly as claimed in claim 7, in which:

(a) the manually actuated latching lever is hinged for rotation with respect to the helm pump mounting and has a cam surface adapted to contact the second latching member to cause the second latching member to move between the engaged and disengaged positions thereof in response to rotation of the latching lever.

9. An assembly as claimed in claim 1, in which:

(a) the helm pump input shaft is rotatable about an input shaft axis, and (b) the helm is aligned with and rigidly connected to the input shaft of the helm pump unit which serves as a steering column.

10. An assembly as claimed in claim 1, in which:

(a) the helm pump mounting has a housing with an outer housing wall having an elongated slot therein, the slot being within a plane of the arc centred on the tilt axis, and (b) the helm pump input shaft has an input shaft axis passing through the slot of the housing.

11. An assembly as claimed in claim 10, in which:

(a) the rotatable helm has a steering column connected thereto to serve as the pump input shaft so as to pass through the slot of the outer housing wall, and (b) a shield portion is secured to the steering column or helm pump input shaft and extends from the column or input shaft in such a way as to effectively partially seal the slot of the housing.

12. An assembly as claimed in claim 11, in which:

(a) the outer housing wall is a portion of an arc centred on the tilt axis, the slot extending generally perpendicularly to the cylindrical surface, and (b) the shield member has a periphery having two side portions having arcuate edge portions adapted to pass closely to the housing outer wall, and two end portions disposed parallel to and adapted to sweep the cylindrical wall and the helm rotates between extreme positions of the arc.

13. A helm pump assembly as claimed in claim 1 further comprising:

(a) a tilting frame connected rigidly to the helm pump unit and hinged to the helm pump mounting to permit said tilting of the rotatable helm about the tilt axis.

14. A helm pump assembly as claimed in claim 13 further comprising:

(a) a latching structure cooperates with the tilting frame and the helm pump mounting to releasably lock the helm pump unit in a desired orientation relative to the helm pump mounting.

15. A helm pump assembly as claimed in claim 14, in which a latching structure comprises:

(a) a first latching member mounted on the tilting frame and having a plurality of spaced apart latching stations extending therealong, and (b) a second latching member complementary to the first latching member and adapted to cooperate with a latching station, the second latching member being hinged for rotation with respect to the helm pump mounting, the second latching member being moveable from an engaged position engaging one of the latching stations and thus holding the helm pump unit in a fixed orientation relative to the helm pump mounting, to a disengaged position in which the latching members are disengaged, thus permitting free rotation of the helm pump unit about the tilt axis between the extreme positions thereof.

16. A helm pump assembly as claimed in claim 1 in which:

(a) the helm pump input shaft has an axis of rotation which intersects the tilt axis.

17. A helm pump assembly as claimed in claim 16 in which:

(a) the axis of rotation of the helm pump input shaft intersects the tilt axis perpendicularly.

* * * * *